US007997461B2

(12) United States Patent
Lester et al.

(10) Patent No.: US 7,997,461 B2
(45) Date of Patent: Aug. 16, 2011

(54) DISCHARGE DEVICE FOR VISCOUS LIQUIDS

(75) Inventors: Joseph Craig Lester, Liberty Township, OH (US); Julius Austria Coronel, Cincinnati, OH (US); Christopher Lawrence Smith, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 718 days.

(21) Appl. No.: 12/074,566

(22) Filed: Mar. 5, 2008

(65) Prior Publication Data

US 2008/0237276 A1 Oct. 2, 2008

Related U.S. Application Data

(63) Continuation-in-part of application No. 11/728,468, filed on Mar. 26, 2007, and a continuation-in-part of application No. 11/728,469, filed on Mar. 26, 2007, and a continuation-in-part of application No. 11/728,363, filed on Mar. 26, 2007.

(51) Int. Cl.
*B67D 3/00* (2006.01)

(52) U.S. Cl. ..... 222/518; 222/509; 222/511

(58) Field of Classification Search ..... 222/501, 222/509, 518, 511
See application file for complete search history.

(56) References Cited

U.S. PATENT DOCUMENTS

| | | | | |
|---|---|---|---|---|
| 3,584,834 | A * | 6/1971 | Reid et al. | 251/321 |
| 3,658,216 | A | 4/1972 | Schwartzman | |
| 4,281,779 | A | 8/1981 | Shepard | |
| 4,452,425 | A | 6/1984 | Lucking | |
| 5,154,212 | A | 10/1992 | Weber | |
| 5,447,257 | A * | 9/1995 | Dark | 222/336 |
| 6,896,158 | B2 * | 5/2005 | Leray et al. | 222/145.1 |
| 7,140,520 | B1 * | 11/2006 | Rutler | 222/511 |
| D575,151 | S * | 8/2008 | Smith et al. | D9/447 |
| 7,455,281 | B2 * | 11/2008 | Craft | 251/335.2 |
| 7,513,395 | B2 * | 4/2009 | Labinski et al. | 222/481.5 |

FOREIGN PATENT DOCUMENTS

WO WO 2006097704 A1 * 9/2006

* cited by examiner

*Primary Examiner* — Frederick C. Nicolas
(74) *Attorney, Agent, or Firm* — Julie A. McConihay; Leonard W. Lewis; Steven W. Miller

(57) ABSTRACT

A gravity discharge device for liquids, especially concentrated liquid detergents, comprises a valve guide system whose surface area optimizes liquid flow. The discharge is especially useful with concentrated ("2×") liquid detergents, whose viscosities tend to unacceptably slow their flow rate from home-use containers, especially when the containers progressively empty after multiple uses.

11 Claims, 11 Drawing Sheets

DISCHARGE DEVICE FOR VISCOUS LIQUIDS

CROSS-REFERENCE TO RELATED APPLICATIONS

This application is a continuation-in-part of U.S. applications Ser. Nos. 11/728,469; 11/728,468; and 11/728,363, all concurrently filed Mar. 26, 2007, the disclosures of which are incorporated herein by reference.

FIELD OF THE INVENTION

This invention relates to improvements in discharge devices, such as diaphragm taps, designed for delivering viscous liquids such as concentrated laundry detergents.

BACKGROUND OF THE INVENTION

The eventual replacement of today's so-called "1×" liquid laundry detergents and liquid fabric softeners with modern, more concentrated "2×" formulations is of considerable commercial importance. Doubling the concentration of active ingredients in such compositions allows usage levels to be halved. Thus, for the same number of product usages, only half the volume of product need be supplied to the consumer. This results in considerable savings in packaging materials and shipping costs, as well as simplifying transportation and storage of the product by the consumer. Importantly, the overall carbon footprint of the product is reduced. Of course, the change-over from (1×) formulations to (2×) formulations is not without its problems. Changing the habits and practices of consumers can be remarkably challenging, especially since most consumers are quite satisfied with their current (1×) products. Accordingly, consumers must be educated regarding the benefits of the (2×) formulations and are quick to notice and assert their displeasure concerning any perceived problems associated with the change-over. On the other hand, consumers do expect some differences in product attributes that signal they are using the new (2×) version, One expected visual and tactile signal for any concentrated liquid formulation is that it be more viscous that its less concentrated version. This expectation is easily met with liquid laundry detergents, due at least in part to the phase properties of the detersive surfactants used therein. For example, conventional (1×) liquid laundry detergents typically have viscosities in the range of 250 to 300 cps, whereas the counterpart (2×) formulations may have viscosities in the range of about 350 to about 700 cps, typically about 350 to about 500 cps.

One quite successful innovation in the marketing of (1×) formulations has been the introduction of large, economy-size containers from which liquid product is dispensed by means of a tap, rather than by pouring. Of course, the introduction of the (2×) formulation does allow the size of the container to be reduced, but tap dispensing is still desirable on the larger product sizes.

Unfortunately, however, it has now been unexpectedly discovered that the higher viscosities of (2×) formulations can result in unacceptably slow product flow through the tap dispensers that are commercially available for (1×) formulations. Moreover, to change the overall design and size of the currently-available taps would require quite expensive retooling. This presents a problem to the manufacturer: to meet consumer expectations for a (2×) product that is more viscous, but has an acceptable flow rate through a dispenser tap that can be produced economically. The present invention addresses this flow problem in a cost-effective manner, as will be seen from the following disclosure.

BACKGROUND ART

U.S. Pat. No. 4,452,425, to Anthony J. Lucking, issued Jun. 5, 1984, describes a plastic diaphragm tap comprising a tubular body open at one end and closed at the other end by a flexible resilient diaphragm. The diaphragm is connected to a shaft comprising a valve element, said valve element being arranged to close a valve seat at the open end of the tap. Finger pressure on the diaphragm displaces the valve element and opens the tap. Conversely, release of said pressure allows the normal resilience of the diaphragm to re-seat the valve element against the valve seat, thereby closing the tap.

The Lucking tap is disclosed for delivering liquids, such as wine or milk, from a storage container. The configurations of the valve seat and valve element in this tap are taught to cooperate so that the valve element self-centers against the valve seat to close the tap in dripless fashion. Reference can be made to U.S. Pat. No. 4,452,425 for details of the manufacture and use of said Diaphragm Tap.

Despite the teachings of U.S. Pat. No. 4,452,425, it has been the experience of the Applicants herein that diaphragm taps cannot be completely relied on to self-center and to satisfactorily close in dripless fashion under all circumstances. As will be appreciated, drippage of liquid laundry products from the tap would be unacceptable to the user of such products. It has also been discovered that, during use, the valve can skew off-center, with the result that liquid product can sometimes exit predominantly towards the rear of the tap, whereas at other times it can exit towards the front. This can lead to product spillage and a poor consumer experience.

In order to ensure proper centering of the valve, which is essential to ensure dripless closure and smooth, repeatable product flow from dose-to-dose, diaphragm taps can be fitted with a valve guide. The valve guide centrally positions the shaft that communicates between the diaphragm and the valve element in the tubular body. The valve guide is typically affixed to the internal walls of the tubular body by means of substantially horizontal support ribs, said ribs fixedly positioning the valve guide substantially concentrically with the midline axis of the tubular body. The valve guide comprises a throughhole through which the shaft slidingly passes as the valve is opened and closed by the respective application and release of pressure on the diaphragm.

Commercial experience with the delivery of conventional (1×) liquid laundry detergents using diaphragm taps that comprise valve guides has been excellent. As noted above, however, it has now been discovered that the flow rate of concentrated (2×) liquid detergents through such taps is too slow for some consumers. This is because the diaphragm tap is gravity-fed. Accordingly, as the product container empties with successive uses and the hydrostatic pressure decreases correspondingly, the flow rate is reduced.

Having discovered the flow rate problem with diaphragm taps used to deliver viscous liquids, it has now also been discovered that a more consumer acceptable flow rate for (2×) products can be achieved by modifying the tap in the manner disclosed herein. Surprisingly, the tap modified according to at least a preferred embodiment of the invention also provides consumer-acceptable flow rates across a range of viscosities, and even for conventional (1×) liquid products. This is a considerable commercial advantage, since the manufacturer of such products, e.g., liquid fabric enhancers such as detergents and softeners, can use the same tap interchangeably with both (1×) and (2×) liquid products.

SUMMARY OF THE INVENTION

In one aspect, the present invention comprises a discharge device comprising a body 100 having a hollow interior 200, said body comprising a liquid inlet portion; a liquid outlet portion comprising a first end and a second end, wherein said first end comprises a button, wherein said liquid outlet has an orifice comprising an orifice surface area comprising a stem and valve system comprising a rib and a valve guide comprising a valve system surface area wherein said stem passes through said valve guide, and wherein, said valve system surface area and said orifice surface area have a ratio of less than about 35%, preferably less than about 30%, or 20% or even 10%.

In one embodiment, the present invention encompasses a discharge device (i.e., "tap") having a liquid outlet with a hollow interior. The valve system is located at the junction of the liquid inlet and the liquid outlet. The valve guide system has a valve guide and a first rib. The valve guide system has a valve guide having a valve guide width. The valve guide width is preferably less than about 1.15 mm. The first rib has a first rib width having a first rib width which is preferably less than about 2.5 mm.

In another embodiment, the invention encompasses a discharge device comprising a body having a hollow interior; a liquid inlet comprising a liquid inlet surface area, a liquid outlet wherein said liquid outlet has a hollow interior comprising a stem and a valve guide comprising a top, a bottom, and a valve guide surface area, said stem passes through said valve guide, and characterized in that said bottom of said valve guide is above (preferably, at least about 3 mm) said liquid inlet.

The invention also encompasses an article of manufacture, comprising a container comprising a reservoir for storing a liquid composition, especially a liquid ("2×") detergent having a viscosity above about 350 cps, and an improved diaphragm tap, as disclosed above and as described more fully hereinafter.

The figures herein are not necessarily drawn to scale.

DETAILED DESCRIPTION OF THE INVENTION

Section A will provide terms which will assist the reader in best understanding the features of the invention, but is not intended to introduce limitations in the terms inconsistent with the context in which they are used in this specification. These definitions are not intended to be limiting.

Section B will discuss the discharge device of the present invention. Section C will discuss examples of the present invention.

A. TERMS

As used herein, the "orifice" is measured as the cross-section of the smallest perimeter of the liquid outlet. Of course, for a cylindrical outlet, the perimeter has a constant value.

The viscosity of the liquid compositions can be measured at 21.1° C. using a Brookfield LV DV II instrument conducted according to the manufacturer's instructions with the #31 spindle run at 60 rpm. This approximates the shear rate, ca. 20 l/sec, of the product being dispensed from the container.

All percentages herein are by weight, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

B. PACKAGE OF THE PRESENT INVENTION

I. Discharge Device

Figure 1:
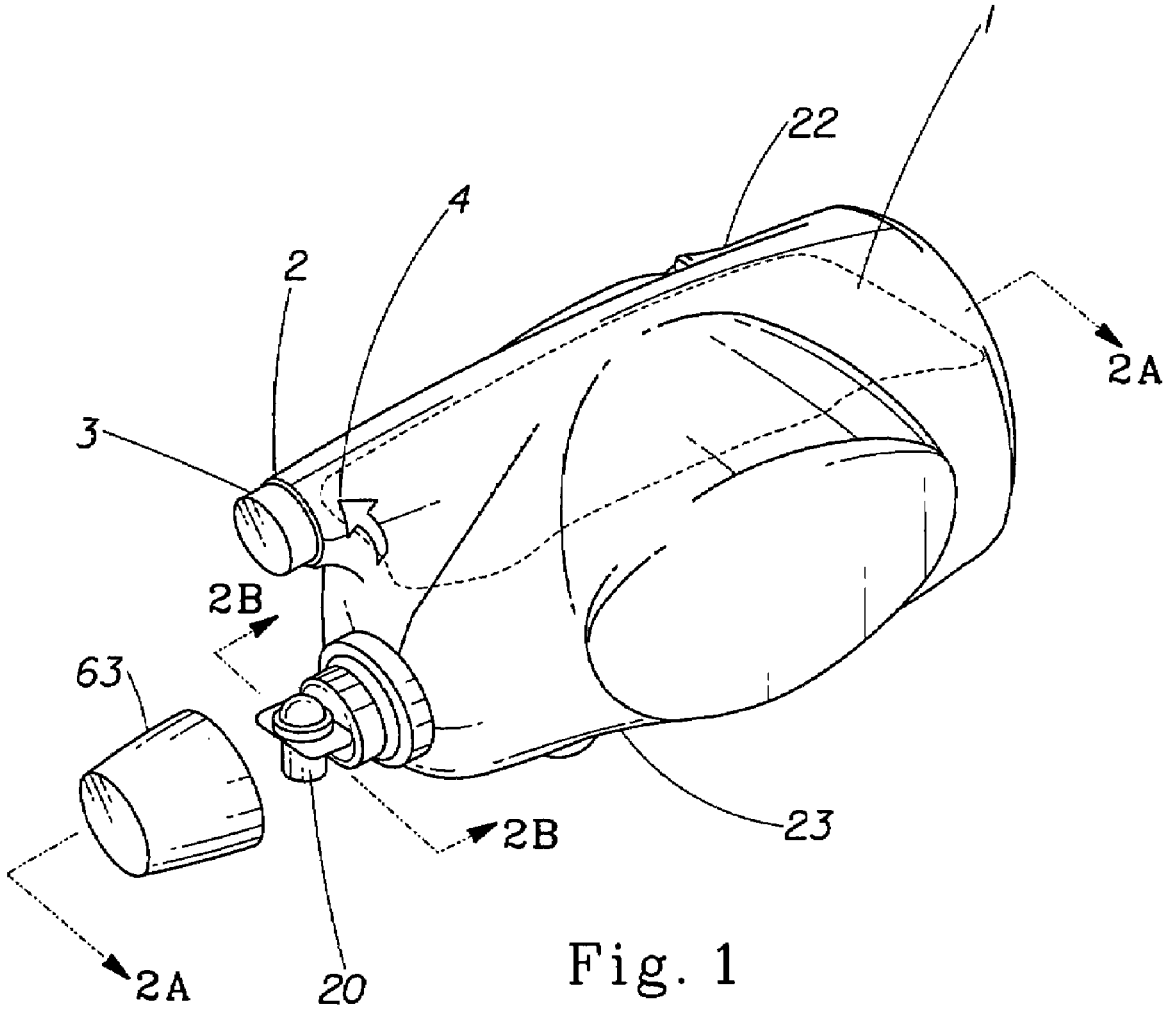
FIG. 1 is a perspective view of an embodiment of the discharge device of the present invention.

Referring to FIG. 1, a discharge device 20 is shown which is designed to dispense a liquid composition 1 from container 22. In this embodiment the container comprises filler opening 2 that can be repeatedly sealed and opened, e.g., with a screw cap 3. In-use, the screw cap is loosened or removed to allow air to enter the container. Indicia, such as arrow 4 or other instructions can be provided on the container as a reminder to the user to loosen the cap during use.

Figure 2A:
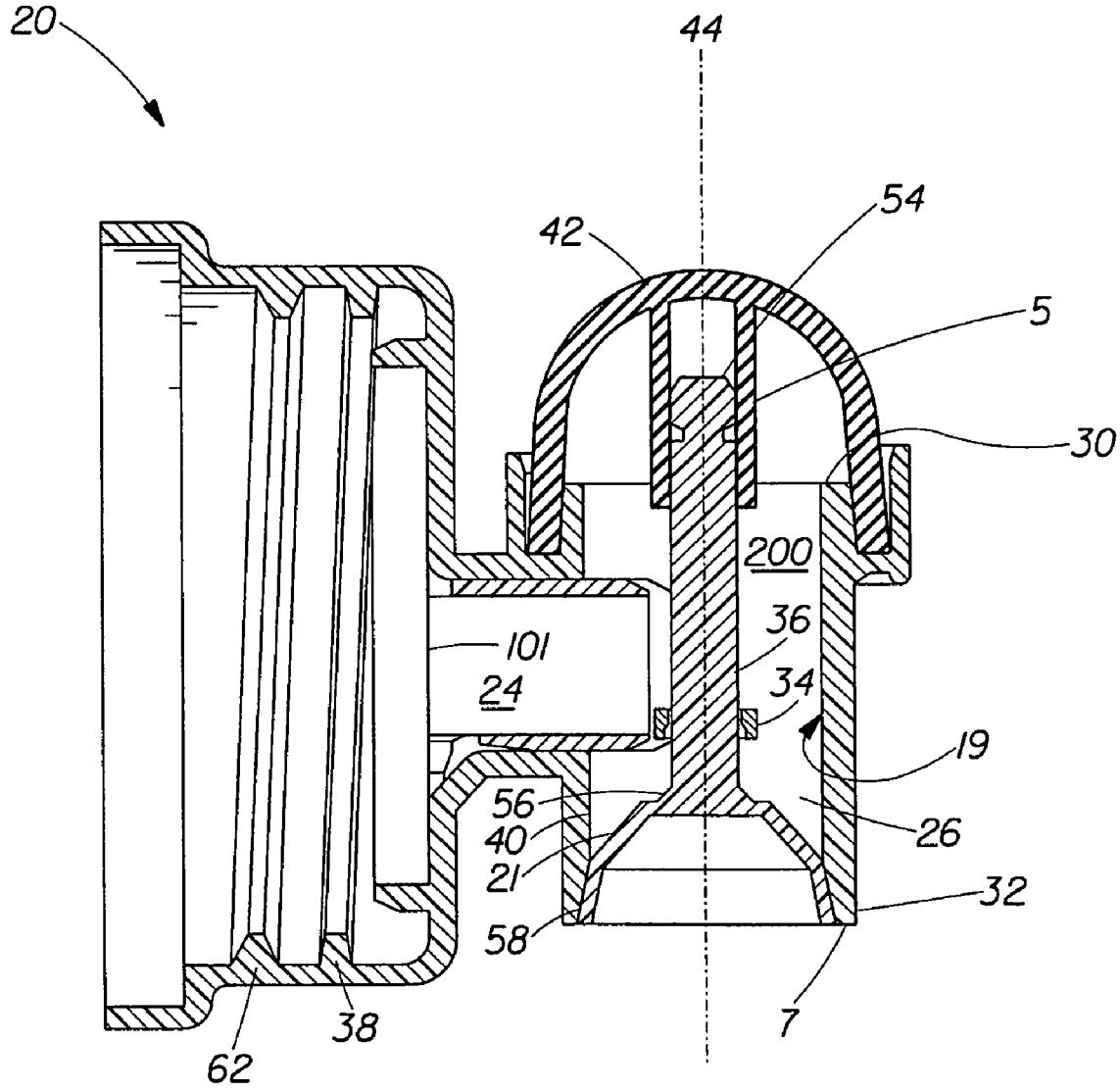
FIG. 2A is a cross-section view along line 2A-2A of the discharge device of FIG. 1.
Figure 2B:
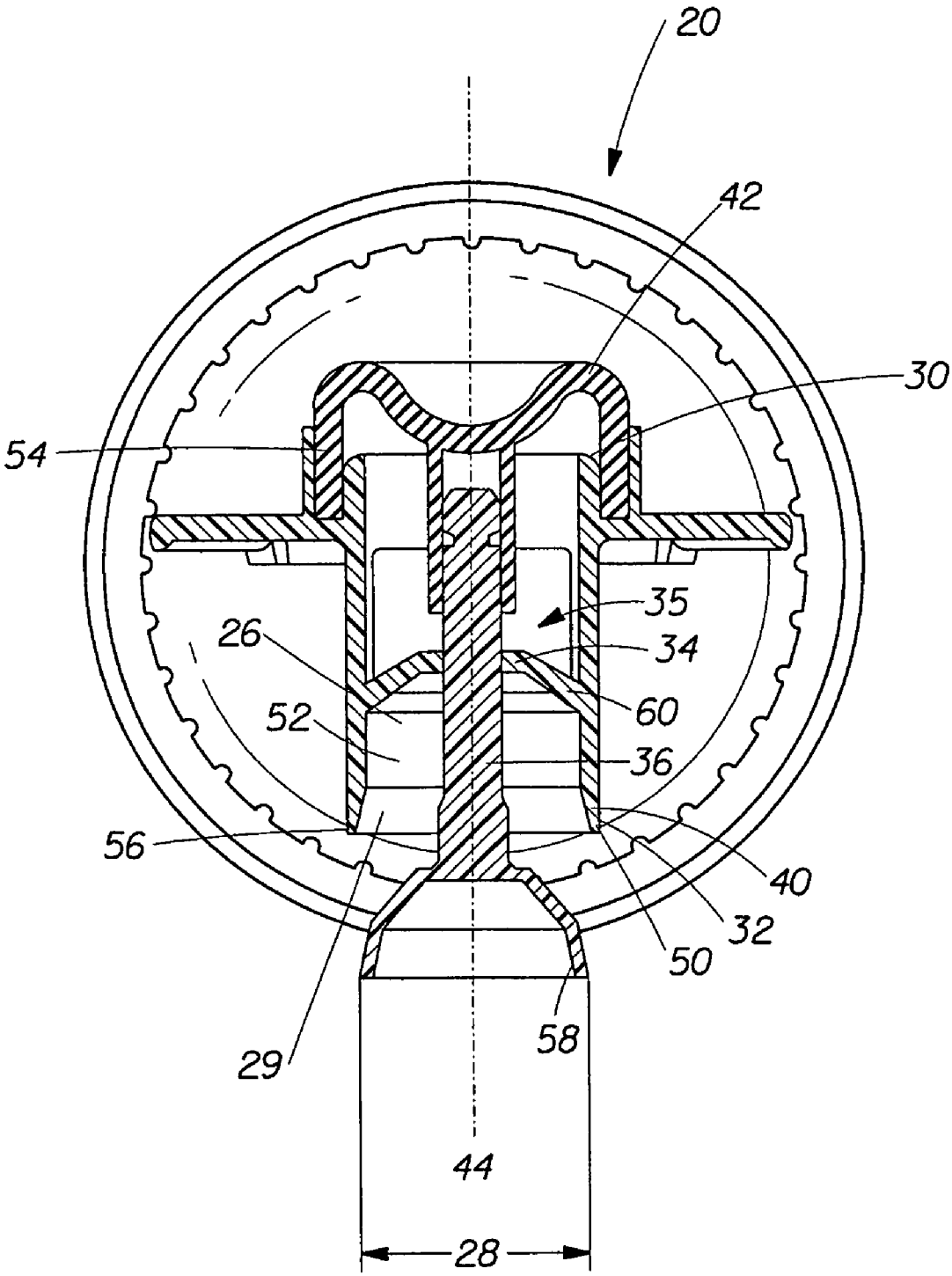
FIG. 2B is a cross-section view along line 2B-2B of the discharge device of FIG. 1 while the button is pressed.
Figure 2C:
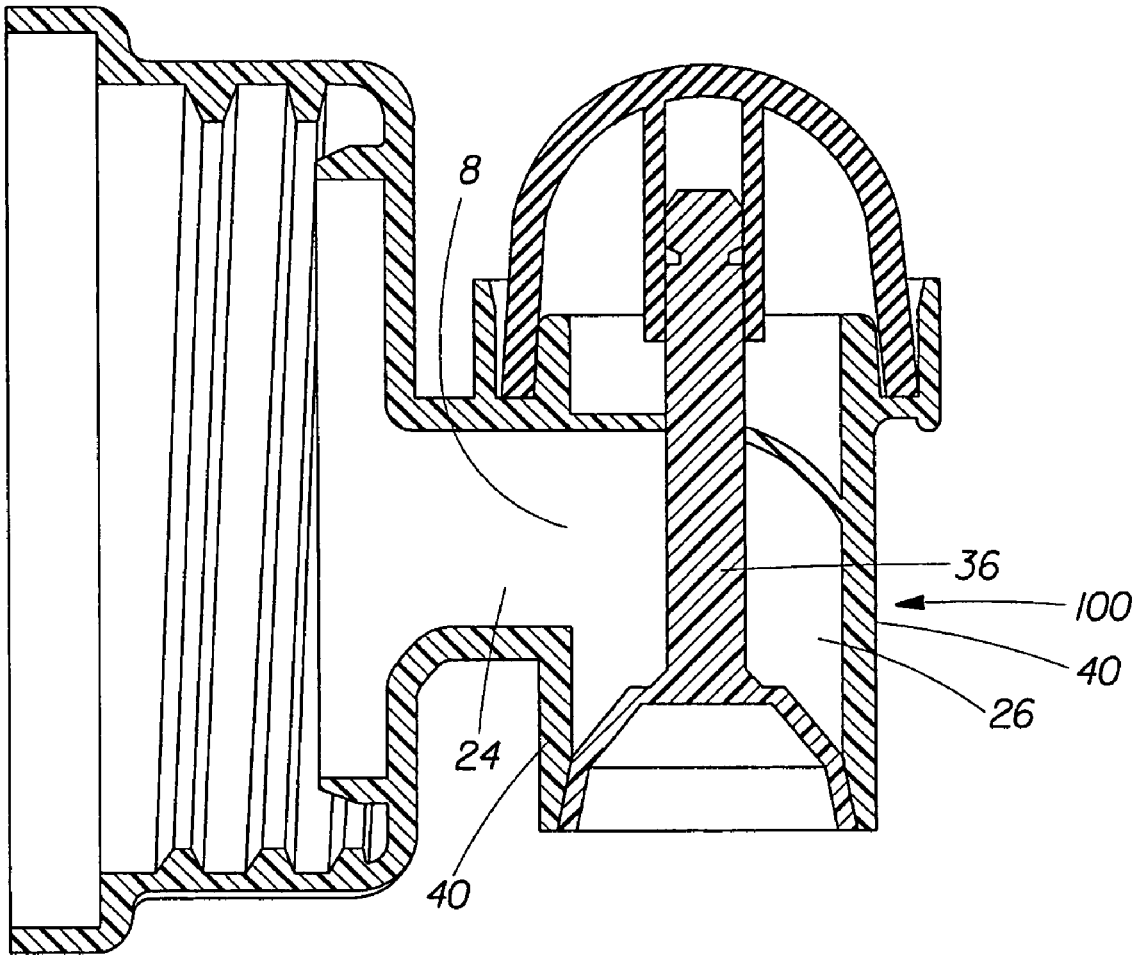
FIG. 2C is a cross-section view along line 2A-2A of an alternative embodiment of the discharge device.
Figure 3:
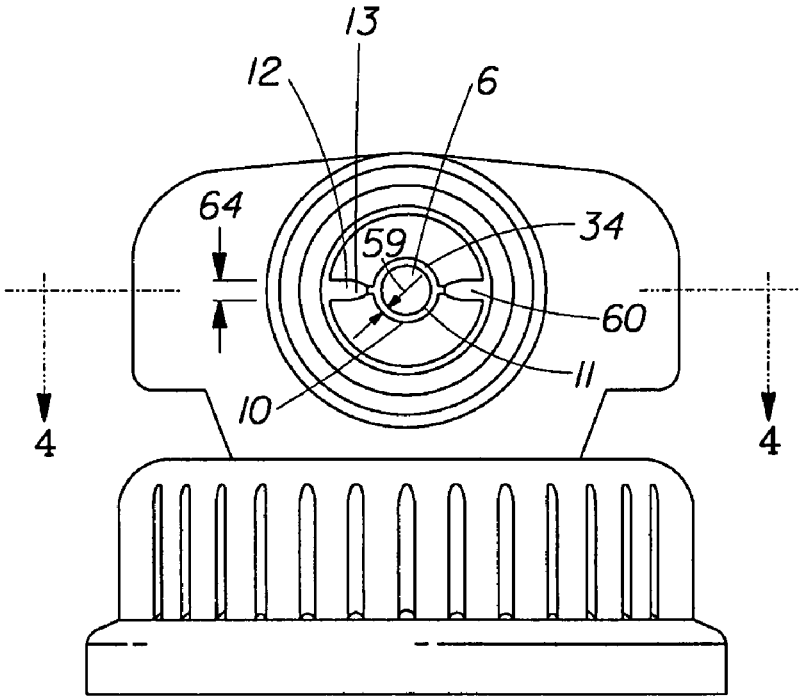
FIG. 3 is a front view of the discharge device.

Referring to FIG. 2A, FIG. 2B and FIG. 2C, the present invention provides a discharge device 20 for dispensing liquids, especially viscous liquids from a container 22 (See FIG. 1). In the embodiment shown, the body 100 of the discharge device 20 has a liquid inlet portion 24 and a tubular liquid outlet portion 26. The tubular liquid outlet portion 26 has an orifice 29, a first (proximal) end 30, and a second (distal) end 32 opposite to the first end 30. The orifice 29 of the tubular liquid outlet portion 26 opens and closes by a valve system 35 (see FIGS. 2A-10B) comprising a stem 36 which passes through the throughhole 6 (see FIG. 3) in valve guide 34. (see FIG. 3) In this embodiment, the stem 36 is fixedly inserted into the downwardly accepting socket 5 of button 42, which, in this embodiment is a domed diaphragm, as discussed more fully hereinafter.

Generally, referring again to FIG. 2A and FIG. 2C, when the button (diaphragm) 42 is unpressed, the stem 36, terminating in a frusto-conical valve element 21, which can be seated in the sidewalls 40 of the tubular liquid outlet portion 26 by compressing against the sidewall 40 so that no liquid can flow from the container 22 (See FIG. 1) with which the discharge device 20 is used. Referring to FIG. 2B, when pressure is applied to the button 42, the stem 36 moves downwardly along the midline axis 44 to unseat the valve element 21 from the outlet orifice 29 which may have conical seating 50 constituted by the walls 40. As a result, liquid flows along a liquid flow passageway around the stem 36 and valve guide 34 and rib(s) 60 and through the valve system 35 (see FIGS. 3-10B). In a preferred embodiment shown in FIG. 2A, the sidewall 40 has a terminal edge 7, which is preferably beveled in order to sealingly seat the frusto-conical valve element 21 when the valve is in the closed position.

Referring to FIG. 1, using a discharge device 20 of this type avoids the problems caused by a number of soap containers, bleach containers, conditioner containers, and other containers around the laundry area. It also eliminates the need for lifting a gallon container or other heavy item for handling this matter by being able to discharge the liquid from any surface. Moreover, it also reduces the amount of time needed to discharge the liquid and simplifies the application of the right amount of the product at the right time, thereby reducing waste. For those without the strength to lift a heavy container, this discharge device 20 and container 22 keep the washing liquid readily available.

The discharge device 20 and container 22 may be formed from any suitable material such as high-density polyethylene, low-density polyethylene, polypropylene or linear low-density polyethylene.

A. LIQUID INLET

Referring to FIG. 2A, generally, the liquid inlet 24 is provided to allow liquid to flow therethough from the container 22 (see FIG. 1) and into and through liquid outlet portion 26 and out of orifice 29.

The attachment 62 can be formed with screw threads 38 (See FIG. 2A) to allow joining of the discharge device 20 to a container 22 (see FIG. 1) at the container's liquid egress port 101 (FIG. 2A). It will be appreciated that the discharge device 20 can be attached to a container 22 in other ways, but a connection which is not destroyed on removal of the discharge device 20 after emptying the container 22 may be preferred because it makes the discharge device 20 reusable. Other ways attachment 62 can be used to attach the discharge device 20 and the container 22 are by pressure seal, an adhesive seal, a locking closure, a screw-type closure, a snap-fit closure, a heat seal, an ultrasonic seal, and/or a plug-seal and may optionally be air-tight and/or water-tight as desired for example, to prevent oxidation of the pourable product, absorption of moisture from the air, and/or water damage to the pourable product.

B. LIQUID OUTLET

Referring to FIG. 2B, the liquid outlet portion 26 of the device 20 is formed to allow liquid to flow therethrough from the container 22 and to provide a seal at the second end 32 of the liquid outlet 26 to prevent liquid from leaking. As stated above, the liquid outlet 26 comprises an orifice 29, which is characterized by its cross-sectional area 28, a first end 30, and a second end 32 opposite to the first end 30. The liquid outlet portion 26 contains a valve guide 34 and a stem 36 which passes through the valve guide 34.

i. Valve System

Referring to FIG. 3-FIG. 10B, the valve system 35 comprises the valve guide 34 and the rib(s) 60. Both are described separately in detail below. The valve system 35 can be located anywhere along the liquid outlet portion 26. As seen in FIG. 2A and FIG. 2B, the valve system 35 can be in the path of the liquid flow passageway. In other words, the liquid is in contact with the valve system 35 when the button 42 is depressed to release the liquid from the container 22.

Alternatively, as seen in FIG. 2C, the valve guide 34 of valve system 35 can be constructed to not be in the path of the liquid flow passageway while the liquid is flowing from the liquid inlet 24 through the liquid outlet portion 26. In this embodiment, the bottom 9 of the valve guide 34 is positioned at or above the junction 8 of the liquid inlet 24 and the outlet portion 26. In other words, the liquid is not in substantial contact with the valve guide when the button is depressed to release the liquid from the container 22. In this embodiment, the valve system 35 is used as a guide for the stem 36 to provide stability, but allows for faster liquid flow because there is not substantial liquid contact with the ribs and valve guide. However, it is to be understood that this is not a preferred arrangement for use herein, since downward pressure during operation of the device can cause the button to undesirably impinge on the valve guide/rib assembly.

a. Valve Guide

Referring to FIG. 2A-FIG. 10C, valve guide 34 is secured to the interior surface 19 of sidewall 40 of the liquid outlet 26 by ribs 60. The valve guide 34 stabilizes the liquid flow profile and provides a maximum flow rate. Referring to FIG. 3-FIG. 10C, the higher flow rate is achieved by decreasing the surface area of the elements of the valve system that limit flow passage, which is the valve system 35. To increase the flow through the valve system 35, the cross sectional area of the valve system 35 is reduced while still maintaining the valve system 35's structural performance. Generally, reducing the cross sectional area also decreases the width 59 of the valve guide 34 and the width 64 of the ribs 60. Accordingly, reducing the width which is perpendicular to the flow of the liquid of the valve system 35 decreases drag on fluid passing through the liquid outlet 26. Stated otherwise, the surface areas of the top side 13 (side facing the proximal end of the device) of the ribs and top side 11 of the valve guide are minimized, compared with current commercial practice, as discussed more fully hereinafter.

Figure 10A:
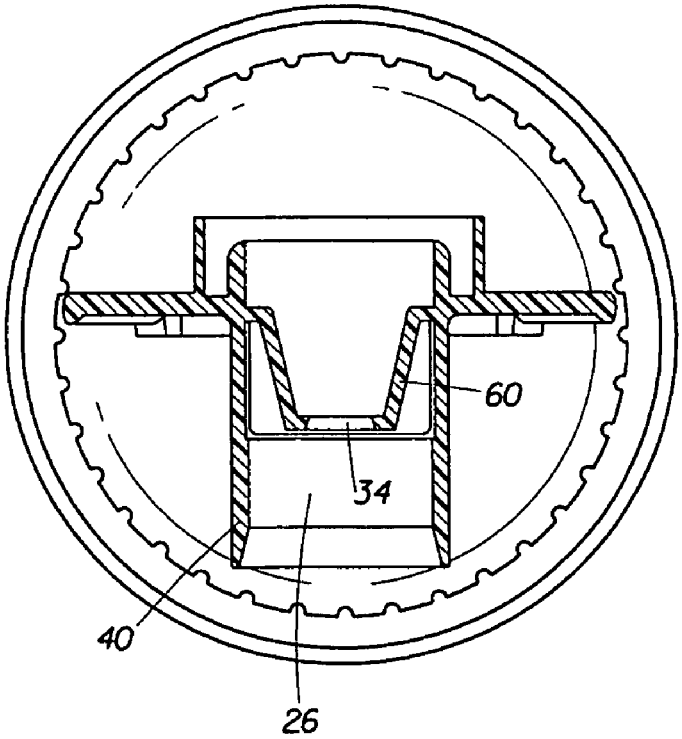
FIG. 10A is a cross-section view along line 10A-10A of the alternative embodiment of the discharge device of FIG. 9.
Figure 10B:
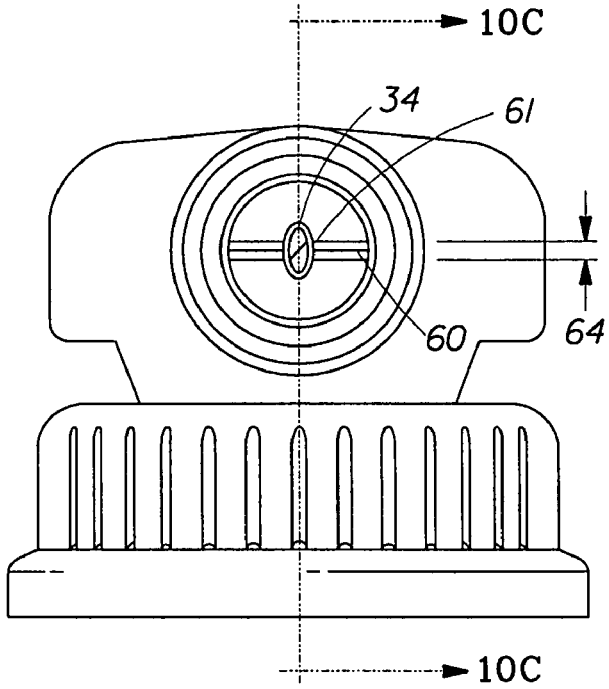
FIG. 10B is a front view of an alternative embodiment of the discharge device.
Figure 10C:
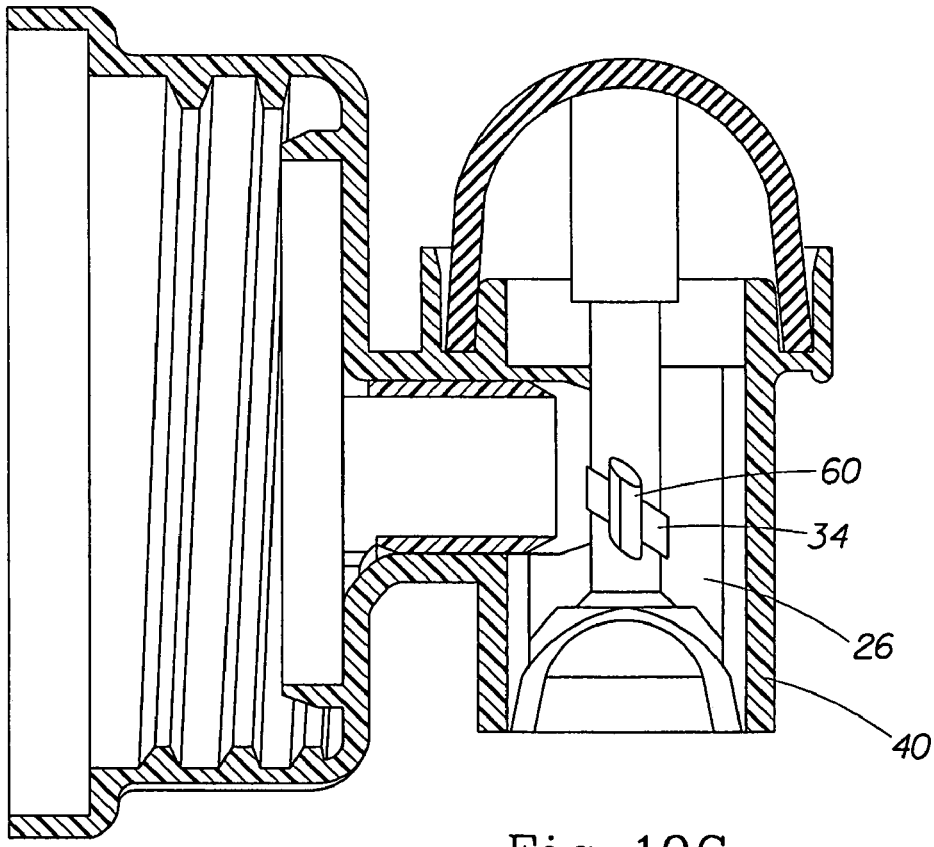
FIG. 10C is the cross-section view along line 10C-10C of the discharge device of 10B.
Figure 11:
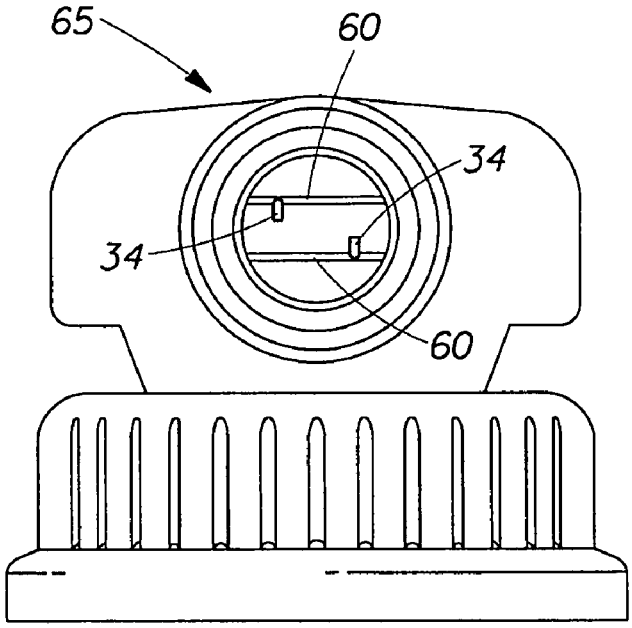
FIG. 11 is a front view of an alternative embodiment of the discharge device.
Figure 12:
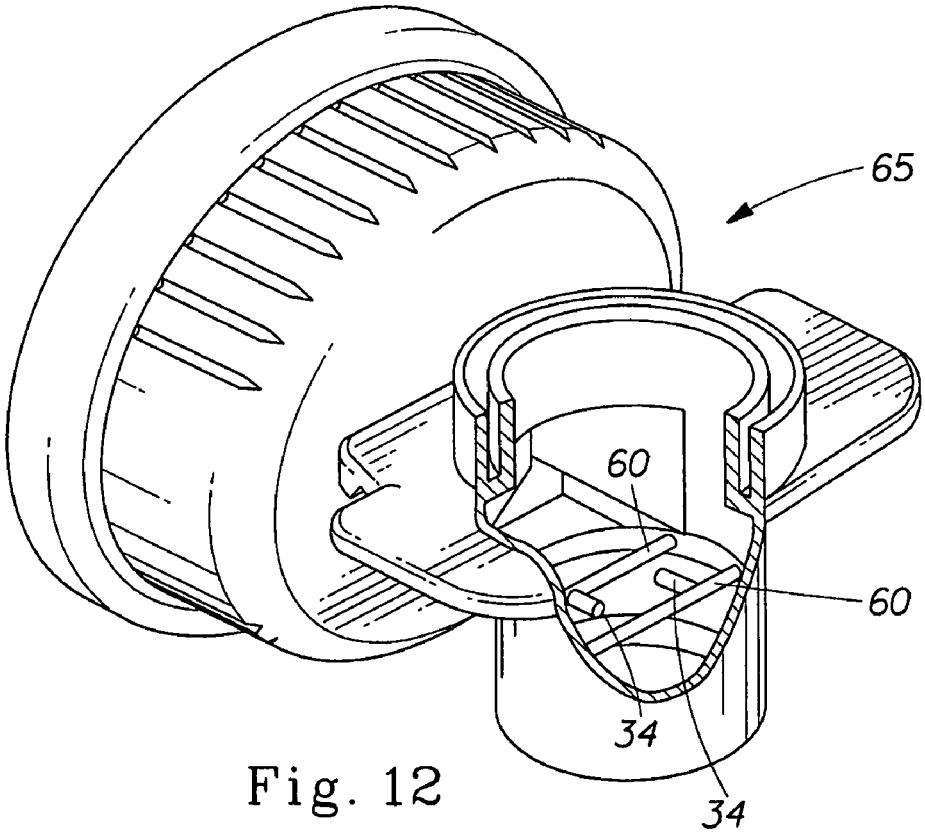
FIG. 12 is a perspective view of an alternative embodiment of the discharge device.

In addition, the valve guide 34 geometry can be changed to increase flow. Referring to FIG. 10B, the width 59 of the valve guide 34 is ovalized 61. The width 59 of the valve guide 34 is preferably at least less than about 1.15 mm.

b. Ribs

Referring to FIGS. 3-10C, the ribs 60 connect the valve guide 34 to the interior surface 19 of the sidewall 40 of the liquid outlet 26. The ribs 60 can be part of the sidewall (i.e., "walls") 40 by molding or may be inserted by being bonded or spin welded. The ribs communicate between the interior surface 19 of the sidewall and the valve guide 34. The width 64 of the ribs 60 is preferably at least less than about 2.5 mms. In this invention, the ribs 60 are reduced in width to decrease drag on fluid passing through (see FIG. 3, 5, 7, 9, 10B) the liquid outlet 26.

Referring to FIG. 4, FIG. 6, FIG. 8, and FIG. 10, in addition, the rib 60 geometry can be changed to increase flow and reduce surface contact of the liquid with the valve system 35.

Figure 4:
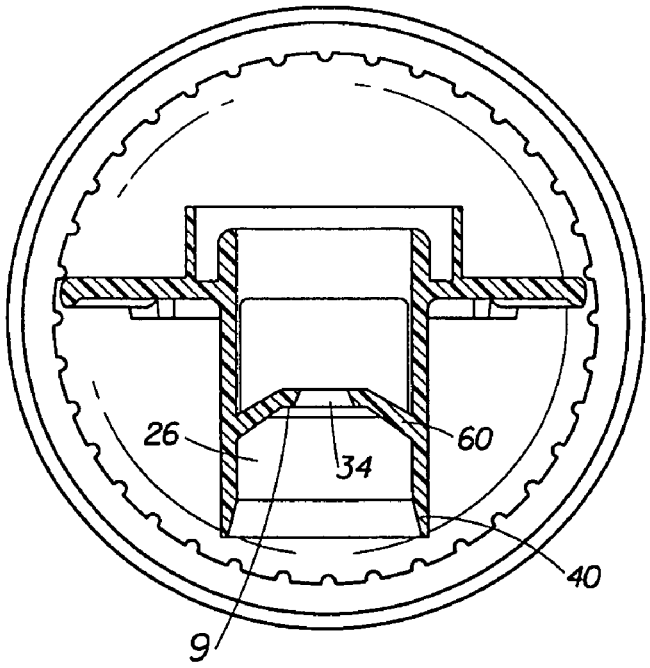
FIG. 4 is a cross-section view along line 4-4 of the discharge device of FIG. 3.
Figure 5:
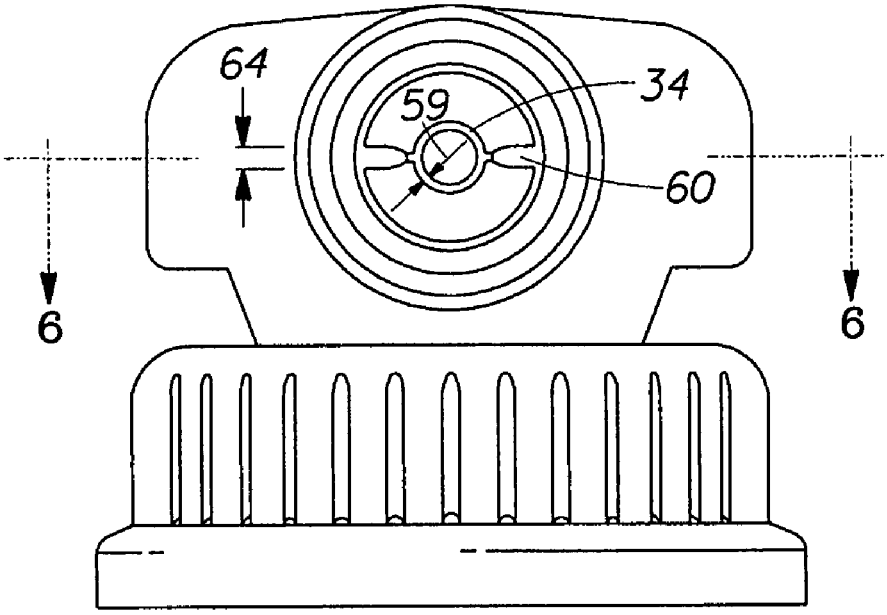
FIG. 5 is a front view of an alternative embodiment of the discharge device.
Figure 6:
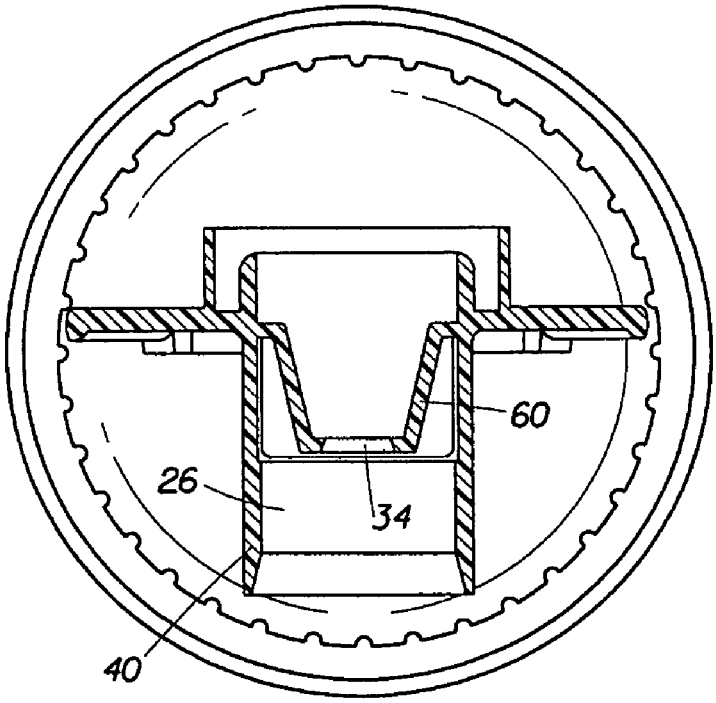
FIG. 6 is a cross-section view along line 6-6 of the alternative embodiment of the discharge device of FIG. 5.
Figure 7:
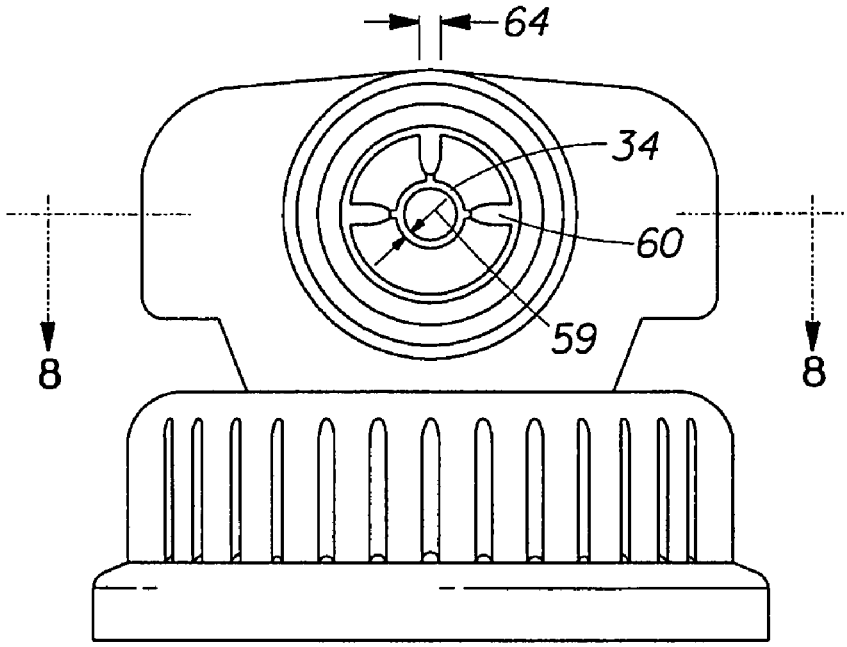
FIG. 7 is a front view of an alternative embodiment of the discharge device.
Figure 8:
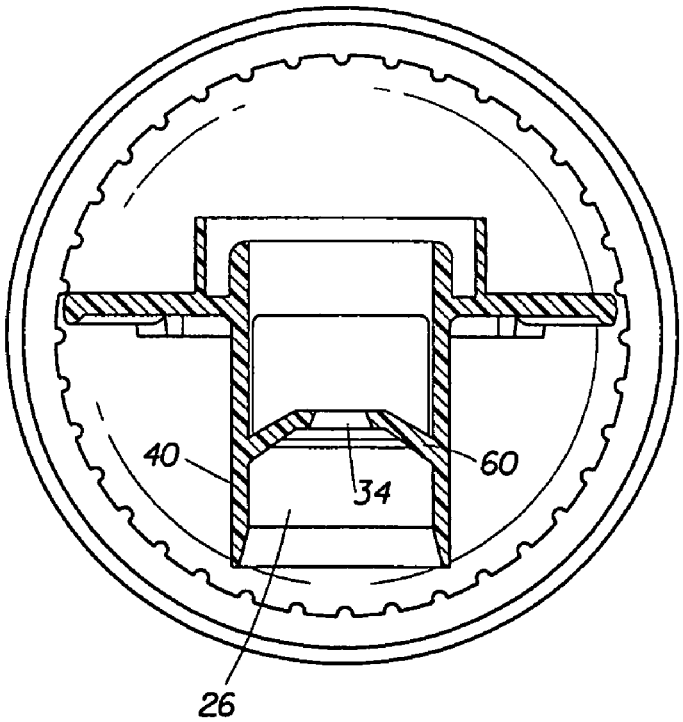
FIG. 8 is a cross-section view along line 8-8 of the alternative embodiment of the discharge device of FIG. 7.
Figure 9:
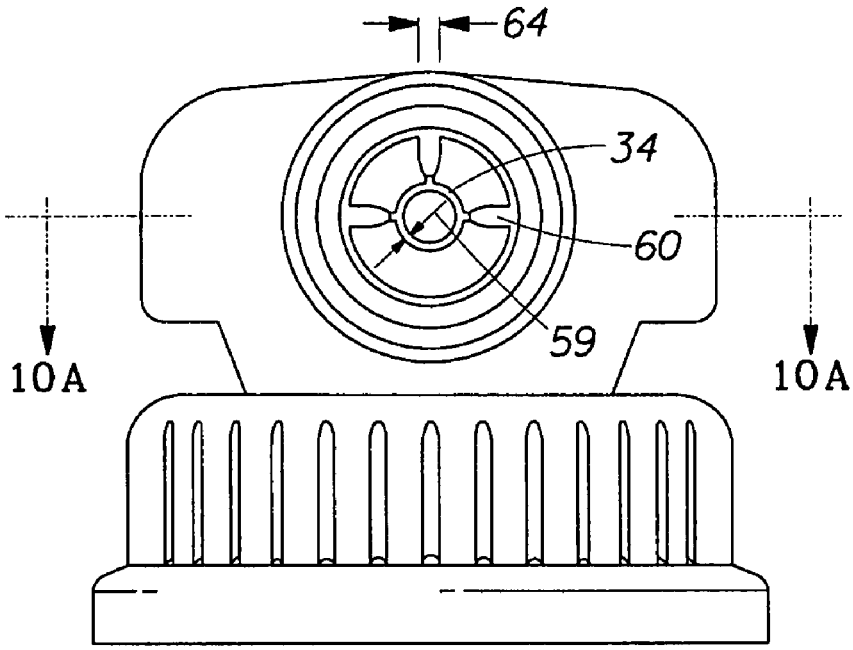
FIG. 9 is a front view of an alternative embodiment of the discharge device.

Referring to FIG. 4 and FIG. 8, the rib 60 may be angled upward where the valve guide 34 is in a plane above the rib 60. Referring to FIG. 10A, in another embodiment, the rib 60 may be angled downward or inverted where the valve guide 34 is in a plane below the rib 60.

ii. Stem

Referring to FIG. 2A and FIG. 2B, the stem 36 forms a connection between the button 42 and the valve element 21 at liquid outlet 26. The stem 36 comprises a first end 54 and a second end 56 opposite to the first end 54. The first end 54 is adjacent to the button 42 and protrudes downwardly from the button 42. The stem 36 can have its first end 54 shown seated in the button 42 and the second end 56 on conical (beveled) seating 50.

The second end 56 of the stem 36 comprises the valve element 21 that seals the outlet 52 of the liquid outlet portion 26 at orifice 29 and is the sealing for controlling the normal or repetitive opening and re-sealing of the discharge device 20. The second end 56 of the stem 36 comprises valve element 21 which can be conical or frusto-conical, and can be arranged to seat on the edge of orifice 29, said orifice comprising a correspondingly tapered 50 edge 7 so as to close the liquid outlet portion 26. The outer edge of the external surface of the valve element is flush with the adjacent part of the second (distal) end 32 of the liquid outlet 26 when the discharge device 20 is closed so that there is virtually no space within which liquid pass by virtue of its surface tension. A sealing bead 58 can optionally surround the stem 36 and/or valve element 21 to ensure adequate contact pressure on the liquid outlet 26 at the terminal edge 7 of orifice 28. The stem 36 passes through a valve guide 34. Typically, the stem 36 (including its valve element) extends the length of the liquid outlet portion 26. The length of the stem 36 can be any length which fits within the liquid outlet portion. In one alternative embodiment, the length of the stem 36 (including valve element 21) can be about 33 mms.

iii. Button

Referring to FIG. 2A and FIG. 2B, when the button 42 is depressed, liquid is released from the liquid outlet portion 26 through outlet 52. Specifically, when the button 42 is depressed, the button 42 acts on the stem 36 movable along axis 44 so that orifice 29 of outlet portion 26 is opened. The stem 36 is supported by the valve guide 34 and rib(s) 60. When the valve is opened, liquid is allowed to flow from the container 22 (see FIG. 1) through the liquid inlet 24 past the stem 36 and valve guide 34 and ribs 60 and out of the orifice 29 of the liquid outlet portion 26. On release of the button 42, the stem retracts and outlet portion 26 is closed.

The button 42 can have a chamfered socket portion. The stem 36 can have its first end 54 shown seated in the button 42 and the second end 56 including the valve element 21, on conical seating 50. The valve element 21 at the second end 56 of the stem 36 seals the outlet of the discharge device 20 and is the sealing for controlling the normal or repetitive opening of the discharge device 20.

In the preferred "diaphragm tap" embodiment shown in the FIGS., the button (i.e., the diaphragm) 42 needs to be resilient, but flexible, so that it is capable of large deformation under manual pressure but subsequently resuming its original shape when the pressure is removed. The button 42 is suitably formed from an elastomeric polymer, for example ethylene vinyl acetate, metallocene polythene or polybutylene terephthlate.

iv. Calculation of the Ratio of the Area of the Orifice Compared to the Valve System The ratio of the area 28 of the orifice 29 (which, in a preferred embodiment, corresponds to the cross-sectional area, i.e., the "bore", of the tubular outlet portion 26) compared to the area of the valve system is calculated by measuring the cross-sectional area, perpendicular to the flow of the liquid, of the valve system 35, i.e., especially the surface area 10 of the top side 11 of the valve guide and the surface area 12 of the top side 13 of the valve guide support ribs and dividing this area by the area 28 of the orifice 29.

To illustrate, the area of the valve system may be calculated as 53.9 square millimeter and the area of the orifice may be calculated as 152.2 square millimeter. Thus, 53.9 divided by 152.2 is the ratio 35.39%. Thus, the discharge device 20 can have ratio of the area 29 of the orifice 28 to the area of the valve system 35 obstructed at less than "about" 35% in the direction of the liquid flow. The software used to determine the area is Sold works 2007.™

II. Container

Referring to FIG. 1, a discharge device 20 having a container 22 of sufficient size to rest on a shelf and sufficient length so that a dispensing mechanism is held conveniently for use provides the necessary solutions to the problems described above. The container 22 can rest on a shelf above the washer. The container 22 can be of sufficient size to hold a suitable amount of powder or liquid for washing purposes.

Preferably, the container 22 has a flat base 23 so that the container 22 can rest easily on a shelf mounted adjacent to the clothes washer. The container 22, at least partially, overhangs a surface (e.g., shelf, washer, dryer). At the overhanging portion of the container 22, there is a discharge device 20. Because the container 22 can be taken down from the shelf, and placed on the washer or other surface to be filled, and the filling aperture in the top of the unit is large, it is easy to refill.

The discharge device 20 can fit a cup 63 marked for measuring the amount of liquid, which can be removably held therein. When it is desired to do laundry, it is possible to remove the cup 63 from the discharge device 20, place the cup beneath the discharge device 20, press the button 42 to open the outlet 52 of the liquid outlet 26, fill the cup 63 with the desired amount of liquid, close the outlet 52 (FIG. 2B) of the liquid outlet 26 by removing any force placed on the button 42 (FIG. 2B), and remove the cup 63 (FIG. 1) from beneath the discharge device 20. Then the contents of the cup 63 (FIG. 1) can be added to the clothes washer in order to do the laundry. The cup 63 (FIG. 1) may be marked in Braille or levels for the amount of material necessary for each load or size of load of laundry. The cup 63 can also be marked to make it simpler for a person lacking laundry skills to determine how much of each laundry material is to be used. In this fashion, the laundry process may be more simply accomplished.

Referring to FIG. 1, as stated above, the container 22 is attached to the discharge device 20. The container material can be any material. It is possible to make the container 22 of a clear plastic so that it can be easily determined when the liquid contained therein is running low, and when the container 22 needs to be refilled. The container 22 may be made of transparent material, translucent material, opaque material or any reasonable combination thereof. The only requirement is that the material be inert to the laundry agent contained therein. Clear bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The transparent container 22 according to the invention preferably has a transmittance of more than 25%, more preferably more than 30%, more preferably more than 40%, more preferably more than 50% in the visible part of the spectrum (approx. 410-800 nm). Alternatively, absorbency of the container 22 may be measured as less than 0.6 or by having transmittance greater than 25% wherein % transmittance equals: 110Absorbancy×100%. For purposes of the invention, as long as one wavelength in the visible light range has greater than 25% transmittance, it is considered to be transparent/translucent. Enzyme deactivation as a result of UV-damage may occur at very low transmission of UV-B radiation through the container wall.

III. Liquid

A variety of laundry agents may be used, kept handy for use and dispensed easily. However, it is to be understood that the formulation per se of liquid laundry detergents and liquid fabric enhancing agents such as fabric softeners forms no part of this invention. Liquid detergents typically comprise one or more anionic and nonionic surfactants, various chelators and builder materials, enzymes, bleaches, corrosion inhibitors, perfumes and an aqueous carrier. Liquid fabric softeners typically an aqueous carrier and one or more cationic and/or silicone ingredients that soften, lubricate and provide an anti-static finish on fabrics. The extensive patent literature in this field can be referred to for examples of such compositions. For convenience, the following is a non-limiting example of a concentrated (2×) liquid laundry detergent for use in the manner of the present invention.

LIQUID LAUNDRY DETERGENT

| INGREDIENT | % BY WEIGHT |
|---|---|
| C12-15 alkyl ethoxylate 4.8 avg EO (commercial paste) | 11.00 |
| C12 alkyl benzene sulfonate | 3.00 |
| Sodium C12 alkyl sulfate (commercial paste) | 2.50 |
| C12-14 alkyl ethoxylate .9 EO | 0.60 |
| Citric acid | 4.00 |
| Ethanol | 1.5 |
| PEG 4000 | 0.08 |
| 1,2 propanediol | 3.0 |
| Monoethanolamine | 2.4 |
| Sodium hydroxide | 1.8 |
| Sodium cumene sulfonate | 0.6 |
| Suds suppressor (DC 1520) | 0.01 |
| Enzymes* | 0.10 |
| Borax | 2.8 |
| Perfume and minors | 0.1 |
| Water | balance |

*mixture of protease, amylase and cellulase

C. EXAMPLES

Examples of some embodiments of the invention are set forth hereinafter by way of illustration and are not intended to be in any way limiting of the invention. The examples are not to be construed as limitations of the present invention since many variations thereof are possible without departing from its spirit and scope. In Examples I-VI the cross-sectional area of the bore of the outlet portion is about 152 mm. In all Examples the valve guide is concentric with midline axis 44.

Example I

A liquid outlet comprises a hollow interior wherein a valve system is located at the junction of the liquid inlet with the outlet portion. The valve system comprises a valve guide and 2 ribs. The valve guide width is 0.75 mms. Each rib width is 1.55 mms wide.

Example II

A liquid outlet comprises a hollow interior wherein a valve system is located at the junction of the liquid inlet with the outlet portion. The valve system comprises a valve guide and 3 ribs. The valve guide width is 0.75 mms. Each rib width is 1.55 mms wide.

Example III

A liquid outlet comprises a hollow interior wherein a valve system is located at the junction of the liquid inlet with the outlet portion. The valve system comprises a valve guide and 1 rib. The valve guide width is 0.75 mms. The rib width is 1.55 mms.

Example IV

A liquid outlet comprises a hollow interior wherein the bottom of the valve guide of the valve system is located from about 1 mm to about 5 mm above the junction of the liquid inlet with the outlet portion. The valve system comprises a valve guide and 2 ribs. The valve guide is 1.0 mm wide. Each rib tapers and has two widths; the first width is 1.0 mm wide and the second width is 1.2 mm.

Example V

A discharge device comprises an orifice surface area and a valve system surface area. The orifice surface area is 152.2 square millimeter. The combination of the ribs and the valve guide comprise a valve system surface area. The valve system comprises 2 ribs and a valve guide. Because the valve system surface area is 29.7 square millimeter and the orifice surface area is 152.2 square millimeter, the ratio of the valve system area and the orifice surface area is 19.5%. The stem is 33 mms in length.

Example VI

A discharge device comprises an orifice surface area and a valve system surface area. The orifice surface area is 152.2 square millimeter. The combination of the ribs and the valve guide comprise a valve system surface area. The valve system comprises 2 ribs and a valve guide. Because the valve system surface area is 32.8 square millimeter and the orifice surface area is 152.2 square millimeter, the ratio of the valve system area and the orifice surface area is 21.6%. The stem is 33 mms in length.

As can be seen from the foregoing, the discharge devices herein may be of various types, but are all characterized by a stem that carries a valve element. The stem/valve element combination rides in the bore of the tubular outlet portion of the device, through which the liquid composition flows to exit the device. The valve guide herein functions to substantially center the shaft in the bore, thereby assuring that the valve element will be properly seated when the valve is closed.

As noted above, the discharge device operates by gravity. The outlet portion of the device comprises a proximal end, i.e., the end where downward pressure is applied by the user to open the valve, and a distal end, i.e., the end from where the liquid composition is discharged when the valve is opened. It will be appreciated that the proximal end can comprise all manner of elements to which downward hand or finger pressure can be applied in order to open the valve. Various tabs, knobs, pads and the like can be envisioned. In general, such elements may be referred to generically as "buttons." In one embodiment, such buttons can be spring-loaded so that the valve is automatically re-seated when the downward pressure is released.

Furthermore, it will be appreciated that the valve stem can be associated with the activator "button" by any convenient means, including, but not limited to, adhesive bonding, screw threads, sweat fitting, and the like.

Likewise, various valve elements for sealing the open distal end of the outlet portion can be envisioned. For example, a simple O-ring closure element would serve the sealing function, as would a washer assembly, and the like.

Figure 13:
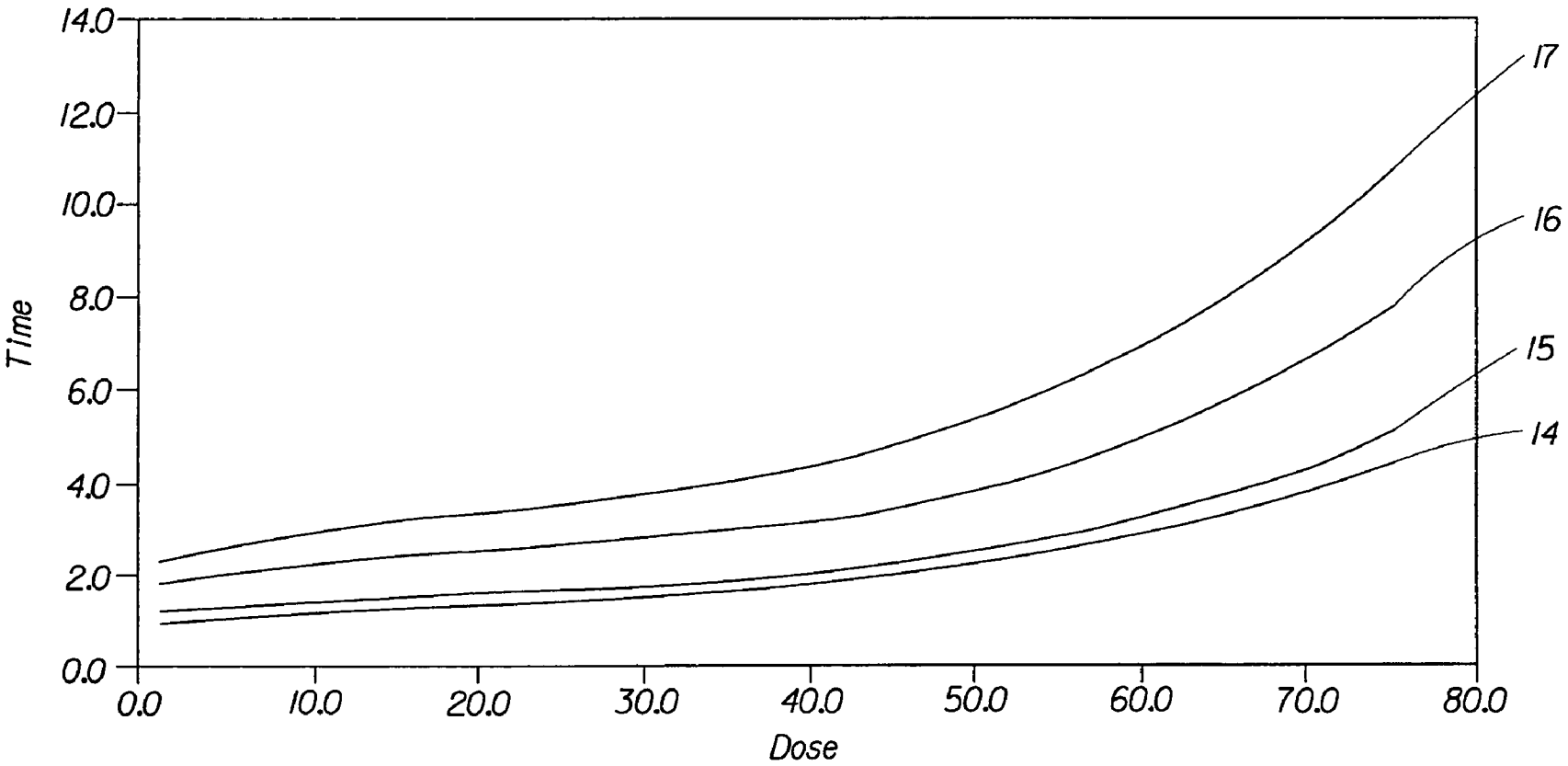
FIG. 13 is a graph showing fluid flow through dispenser taps.

FIG. 13 illustrates the flow problem associated with (2×) liquid detergents using current, commercial discharge devices and the solution afforded by the present invention.

FIG. 13 is a graphical representation of the flow of a liquid detergent from a container through the tubular outlet portion (bore) of domed taps. The variation in flow as the container progressively empties is clearly seen for both (1×) and (2×) compositions. In FIG. 13, the valve guide comprising an annular ring is held in place by support ribs in the flow path of the liquid detergent flowing through the bore and exiting the tubular outlet portion of the tap. In FIG. 13, curve 14 illustrates the flow of a (1×) liquid detergent having a viscosity of about 190 cps using a container comprising a preferred domed tap according to the present invention having a so-called "thin" valve guide with two support ribs and an annular ring, as described hereinafter. Curve 15 illustrates the flow of a (1×) liquid detergent with a current commercial valve guide having four support ribs and an annular ring, whose total top surface area is about twice that of the aforesaid "thin" device herein. Curve 16 illustrates the flow of a (2×) liquid detergent having a viscosity of about 465 cps using the "thin" device of a preferred embodiment of the present invention. Curve 17 shows the flow of the (2×) detergent with the aforesaid current commercial four-rib device.

As can be seen, an improvement in flow of about 30% is achieve by the present device as compared with the current commercial device when considering the latter stages of delivery of a (2×) liquid detergent.

Having thus described various aspects of the present invention, the following describes and exemplifies preferred, but non-limiting embodiments of the preferred devices herein, comprising diaphragm taps, and their use, but is not intended to limit the scope of the invention.

In one aspect, the invention encompasses, an article of manufacture, comprising:

a) a container comprising a liquid composition releasably housed within said container;

b) a diaphragm tap associated with said container for dispensing said liquid composition, said tap comprising:

i) a tubular outlet portion having a cross-sectional area (e.g., about 120-200 $mm^2$; preferably about 150 $mm^2$), said tubular outlet portion comprising an open proximal end and an open distal end, said distal end comprising a terminal edge, said tubular outlet portion comprising a sidewall having an inner surface;

ii) an inlet portion integrally formed with the sidewall of said tubular outlet portion at a junction (and, in a non-limiting example, intersecting at about a 90° angle), said inlet portion being associated with said container and providing fluid communication for said composition between said container and said tubular outlet portion;

iii) a valve assembly comprising a flexible resilient domed diaphragm fitted around the open proximal end of said tubular outlet portion and extending upwardly therefrom and comprising a downwardly accepting socket for receiving the first end of a stem, said stem carrying a valve element at its second end, said valve element being frusto-conical and configured to seat at the distal end, preferably on said terminal edge of the distal end, of said outlet portion, said terminal edge preferably being beveled to sealingly match said frusto-conical valve element; and iv) a valve guide, preferably comprising an annular fitment (preferably, ring), said valve guide having a throughhole through which said stem slidingly passes, said valve guide being substantially centrally affixed with respect to the sidewall in said tubular outlet portion by means of support ribs communicating between said valve guide and the inner surface of the sidewall of said tubular outlet portion. In one aspect of the invention, said tap is characterized by: said valve guide and support ribs, together, having a total top surface area that is less than about 35%, preferably less than about 30%, most preferably less than about 20%, or even 10%, of the cross-sectional area of said tubular outlet portion of said tap. In a highly preferred mode, two support ribs are used to affix the valve guide, which is most preferably an annular ring. (Shown as 24 in FIG. 9)

In another aspect of the invention, said diaphragm tap employed on said article comprises a valve guide, preferably an annular ring, having a top surface area less than about 20.4 mm2, preferably from about 5 mm2 to about 15 mm2, and two support ribs, said two support ribs, together, having a top surface area less than about 21 mm2; and in a highly preferred mode, said tubular outlet portion has a cross-sectional area (i.e., bore) from about 145 mm2 to about 175 mm2.

In still another aspect, the invention encompasses the diaphragm taps described above per se for dispensing a liquid composition from a container, said taps being associable with said container via the inlet portion of said taps.

Example VII

A preferred article herein is as follows:

The body of a diaphragm tap is molded from polypropylene plastic. The tap body comprises a substantially cylindrical tubular outlet portion having a sidewall thickness of about 1.4 mm, a cross-sectional bore area of about 152 mm and a length of about 22 mm. The terminal edge of the open distal end of the outlet portion is beveled at an angle of about 15 degrees. The open proximal end of the outlet portion is sealingly capped with a flexible, resilient domed diaphragm, available from Worldwide Dispensers, Lester Prairie, Minn., which extends upwardly about 10 mm from the tubular outlet portion.

An inlet portion is integrally formed at about mid-point of said tubular portion and has a rectangular orifice communicating with the bore of the tubular outlet portion for the passage of liquid composition. The rectangular orifice has an area of about 144 $mm^2$.

A valve guide comprising a ring having a wall thickness of about 0.75 mm and a wall depth of about 1.6 mm is positioned centrally in the bore of the tubular portion by means of two support ribs positioned at 180 degrees from each other on the periphery of the valve guide. The ribs are joined to the inner wall of the tubular outlet portion at an upward angle of about 45° to provide improved support for the valve guide, as compared with horizontal placement of such ribs. In this embodiment, each rib is of the same size and is about 4.4 mm in length, 1.4 mm thick and about 2.0 mm in width, on average (the rib tapers from 2.41 mm to 1.55 mm–avg=2.0)

The valve guide comprises a central throughhole having a diameter of about 4.5 mm and has an outside diameter of about 6.0 mm.

The operational valve comprises Rigidex™ plastic, has an overall length of about 32 mm and comprises a cylindrical stem whose diameter is about 3.1 mm, which terminates in a frusto-conical valve element at its distal end whose dimensions match the beveled end of the outlet portion. The stem passes through the throughhole of the valve guide and the proximal end of the stem is snugly fitted into a downwardly accepting socket that is molded into the domed diaphragm, and is thereby maintained in a concentric position with respect to the midline of the bore of the outlet portion of the tap.

The diaphragm tap is affixed to a container (typical range 3.0-10 liters) comprising a liquid laundry detergent having a typical viscosity range of about 190-500 cps, such that the outlet portion is substantially vertical. In-use, the assembly is judged by a panel of users to provide quite acceptable flow rates for the liquid detergent over repeated usages.

While the foregoing illustrates a preferred, two-ribbed version of the tap herein, it is to be understood that the tap herein can comprise a plurality (i.e., 3, 4 or more) of such ribs, as long as the sum of their areas does not cause the total surface area of the guide structure to exceed what is disclosed herein. The taps according to the present invention provide consumer-acceptable flow rates for liquids in the 250-700 cps range of viscosities.

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An article of manufacture, comprising:

a.) a container comprising a liquid composition releasably housed within said container;

b.) a diaphragm tap associated with said container for dispensing said liquid composition, said tap comprising:

i.) a tubular outlet portion having a cross-sectional area, said tubular outlet portion comprising an open proximal end and an open distal end, said distal end comprising a terminal edge, said tubular outlet portion comprising a sidewall having an inner surface;

ii.) an inlet portion integrally formed with the sidewall of said tubular outlet portion at a junction, said inlet portion being associated with said container and providing fluid communication for said composition between said container and said tubular outlet portion;

iii.) a valve assembly comprising a flexible resilient domed diaphragm fitted around the open proximal end of said tubular outlet portion and extending upwardly therefrom and comprising a downwardly accepting socket for receiving the first end of a stem, said stem carrying a valve element at its second end, said valve element being frusto-conical and configured to seat on said terminal edge of the distal end of said outlet portion; and iv.) a valve guide having a throughhole through which said stem slidingly passes, said valve guide being substantially centrally affixed with respect to the sidewall in said tubular outlet portion by means of support ribs communicating between said valve guide and the inner surface of the sidewall of said tubular outlet portion, said tap being characterized by: said valve guide and support ribs, together, having a top surface area that is less than about 35% of the cross-sectional area of said tubular outlet portion of said tap.

2. An article according to claim 1 wherein said tap comprises two of said support ribs and wherein said valve guide is an annular ring.

3. An article according to claim 2 wherein the top surface area of the valve guide and support ribs, together, is less than about 20% of the cross sectional area of said tubular portion of said tap.

4. An article according to claim 1 wherein said liquid composition is a laundry detergent having a viscosity from about 250 cps to about 700 cps.

5. An article of manufacture, comprising:

a.) a container comprising a reservoir for storing a liquid composition releasably housed within said container;

b.) a diaphragm tap associated with said container for dispensing said liquid composition, said tap comprising:

i.) a tubular outlet portion having a cross-sectional area, said tubular outlet portion comprising an open proximal end and an open distal end, said distal end comprising a terminal edge, said tubular outlet portion comprising a sidewall having an inner surface;

ii.) an inlet portion integrally formed with the sidewall of said tubular outlet portion at a junction, said inlet portion being associated with said container and providing fluid communication for said composition between said container and said tubular outlet portion;

iii.) a valve assembly comprising a flexible risilient domed diaphragm fitted around the open proximal end of said tubular outlet portion and extending upwardly therefrom and comprising a downwardly accepting socket for receiving the first end of a stem, said stem carrying a valve element at its second end, said valve element being frusto-conical and configured to seat at the distal end on said terminal edge of the distal end of said outlet portion; and iv.) a valve guide comprising an annular ring having a throughhole through which said stem slidingly passes, said annular ring being substantially centrally affixed with respect to the sidewall in said tubular outlet portion by means of two support ribs communicating between said annular ring and the inner surface of the sidewall of said tubular outlet portion, said tap being characterized by: said annular ring having a top surface area less than about 20.4 mm2, and said two support ribs, together, having a top surface area less than about 21 mm2.

6. An article according to claim 5 wherein the tubular outlet portion has a cross-sectional area from about 145 mm2 to about 175 mm2.

7. An article according to claim 5 wherein the viscosity of the liquid composition is from about 250 cps to about 700 cps.

8. An article according to claim 7 wherein the liquid composition is a laundry detergent.

9. A diaphragm tap for dispensing a liquid composition from a container, said tap comprising:

i.) a tubular outlet portion having a cross-sectional area, said tubular outlet portion comprising an open proximal end and an open distal end comprising a terminal edge, said tubular outlet portion comprising a sidewall having an inner surface;

ii.) an inlet portion integrally formed with the sidewall of said tubular outlet portion at a junction, said inlet portion being associable with said container for providing fluid communication for said composition between said container and said tubular outlet portion;

iii.) a valve assembly comprising a flexibile resilient domed diaphragm fitted around the open end of said tubular outlet portion and extending upwardly therefrom and comprising a downwardly accepting socket for receiving the first end of a stem, said stem carrying a valve element at its second end, said valve element being frusto-conical and configured to seat on said terminal edge of the distal end of said outlet portion; and iv.) a valve guide comprising a throughhole through which said stem slidingly passes, said annular ring being substantially centrally affixed with respect to the sidewall in said tubular outlet portion by means of two support ribs communicating between said valve guide and the inner surface of the sidewall of said tubular outlet portion, said tap being characterized by: said valve guide and support ribs, together, having a top surface area that is no greater than about 35% of the cross-sectional area of said tubular portion of said tap.

10. A diaphragm tap for dispensing a liquid composition from a container, said tap comprising:

i.) a tubular outlet portion having a cross-sectional area, said tubular outlet portion comprising an open proximal end and an open distal end comprising a terminal edge, said tubular outlet portion comprising a sidewall having an inner surface;

ii.) an inlet portion integrally formed with the sidewall of said tubular outlet portion at a junction, said inlet portion being associable with said container for providing fluid communication for said composition between said container and said tubular outlet portion;

iii.) a valve assembly comprising a flexible resilient domed diaphragm fitted around the open end of said tubular outlet portion and extending upwardly therefrom and comprising a downwardly accepting socket for receiving the first end of a stem, said stem carrying a valve element at its second end, said valve element being frusto-conical and configured to seat on said terminal edge of the distal end of said outlet portion; and iv.) a valve guide comprising an annular ring having a throughhole through which said stem slidingly passes, said annular ring being substantially centrally affixed with respect to the sidewall in said tubular outlet portion by means of two support ribs communicating between said annular ring and the inner surface of the wall of said tubular outlet portion, said tap being characterized by:

said annular ring having a top surface area less than about 20.4 mm2, and each of said two support ribs, together, having a top surface area less than about 21 mm2.

11. An article according to claim 10 wherein the outlet portion has a cross-sectional area of about 120 mm2 to about 200 mm2.

* * * * *